United States Patent [19]

MacMaster et al.

[11] 3,946,187

[45] Mar. 23, 1976

[54] MICROWAVE BROWNING UTENSIL

[75] Inventors: George H. MacMaster, Lexington; Kenneth W. Dudley, Sudbury, both of Mass.

[73] Assignee: Raytheon Company, Lexington, Mass.

[22] Filed: Mar. 3, 1975

[21] Appl. No.: 554,861

[52] U.S. Cl. ..... 219/10.55 E; 99/DIG. 14

[51] Int. Cl.[2] ..... H05B 9/06

[58] Field of Search 219/10.55 E, 10.55 F, 10.55 M; 99/451, DIG. 14

[56] References Cited

UNITED STATES PATENTS

| | | | |
|---|---|---|---|
| 3,230,864 | 1/1966 | Krajewski | 99/DIG. 14 |
| 3,591,751 | 7/1971 | Goltsos | 219/10.55 E |
| 3,662,141 | 5/1972 | Schauer, Jr. | 219/10.55 E |
| 3,701,872 | 10/1972 | Levinson | 219/10.55 E |
| 3,809,845 | 5/1974 | Stenstrom | 99/451 |
| 3,845,266 | 10/1974 | Derby | 219/10.55 E |
| 3,857,009 | 12/1974 | MacMaster et al. | 219/10.55 E |
| 3,878,350 | 4/1975 | Takagi | 219/10.55 E |
| 3,881,027 | 4/1975 | Levinson | 219/10.55 E |

FOREIGN PATENTS OR APPLICATIONS

| | | | |
|---|---|---|---|
| 1,596,475 | 7/1970 | France | 99/DIG. 14 |
| 7,004,169 | 9/1970 | Netherlands | 219/10.55 E |

*Primary Examiner*—Arthur T. Grimley
*Attorney, Agent, or Firm*—Edgar O. Rost; Joseph D. Pannone; Herbert W. Arnold

[57] ABSTRACT

A microwave browning and searing utensil for microwave ovens is provided having a plurality of conductive metal members each folded in such a manner as to provide a continuous apex portion and two substantially equidistant adjacent legs spaced apart and defining two free ends. The legs are substantially one-quarter of a wavelength in height. The induced electric currents along the legs results in a total current excursion of one-half of a wavelength to establish a 180° phase reversal plus and minus mode adjacent to the exposed ends. Planar microwaves radiated within an oven enclosure are converted by the array of conductive members to provide an intense fringing electric field 180° out-of-phase in close proximity to the material being heated. The fringing electric fields decay exponentially a short distance away from the exposed ends. A low dielectric constant dielectric material such as Silastic reduced the length of the conductive leg members for the quarter wavelength dimension to result in a thinner browning member.

6 Claims, 5 Drawing Figures

FIG. 1
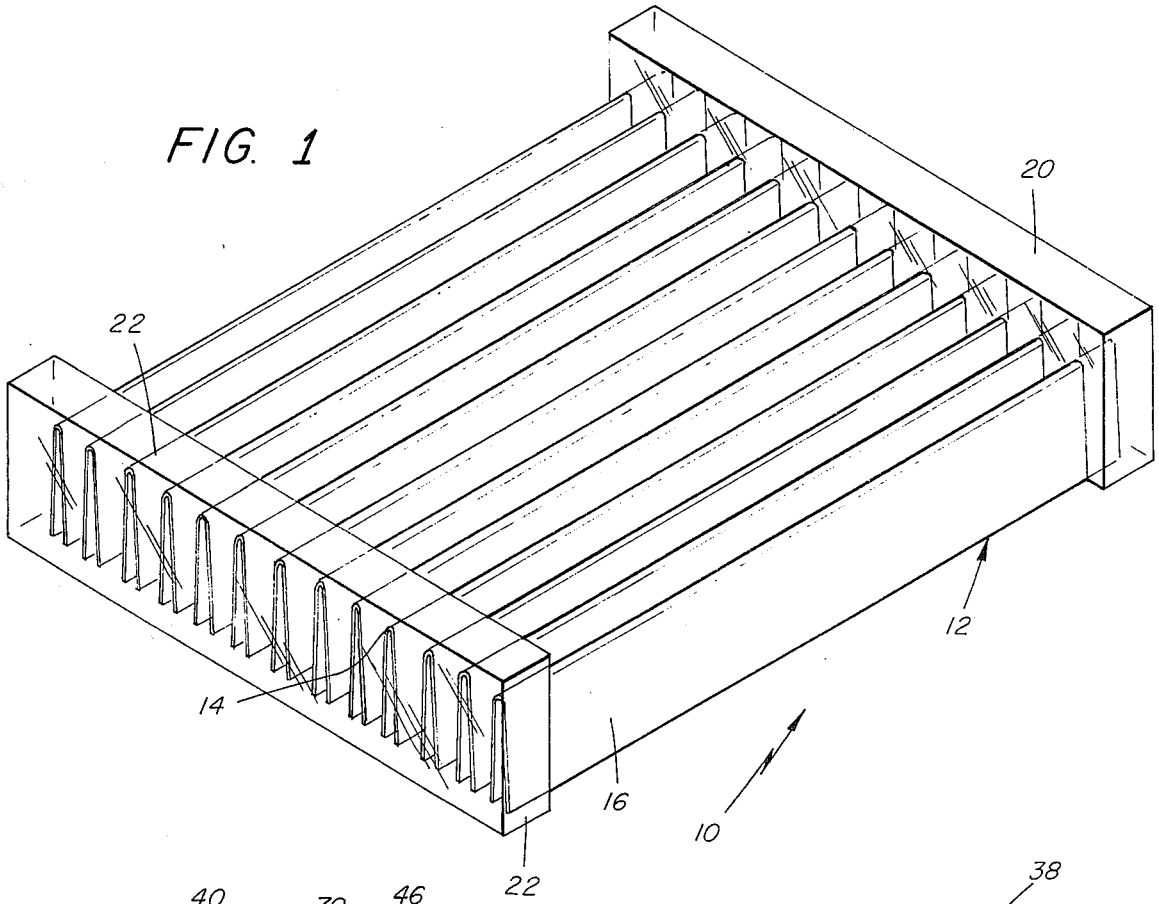
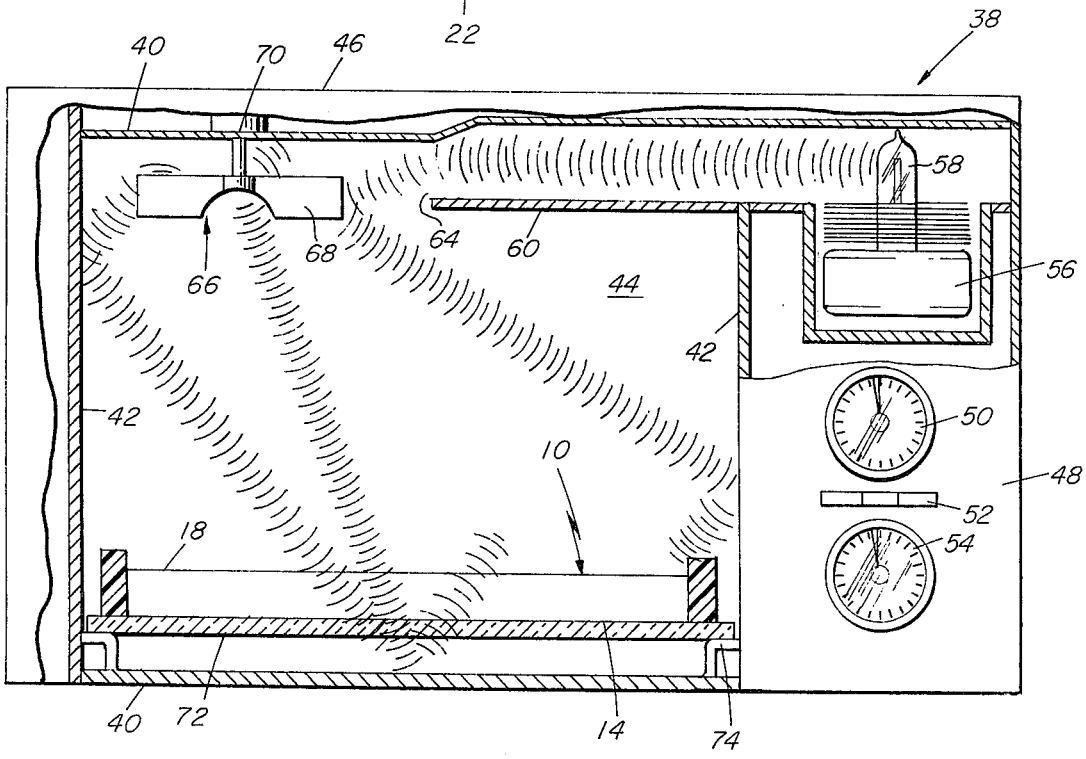
FIG. 2

FIG. 3
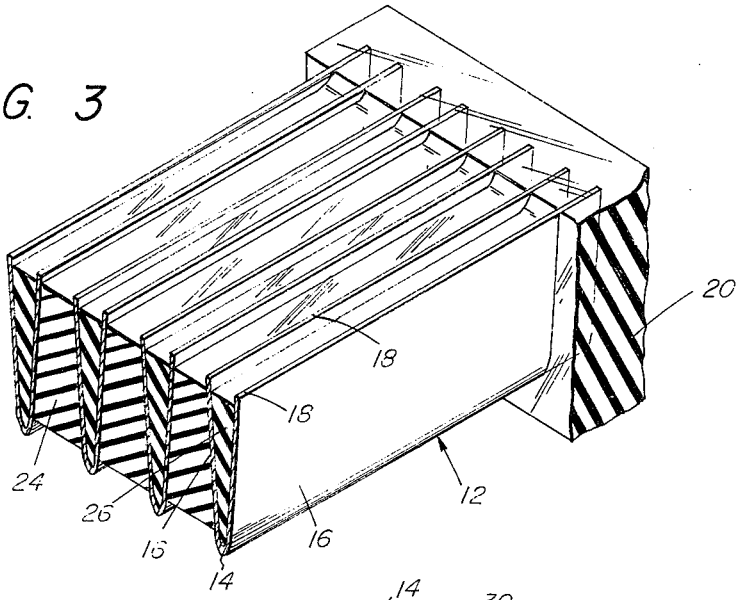
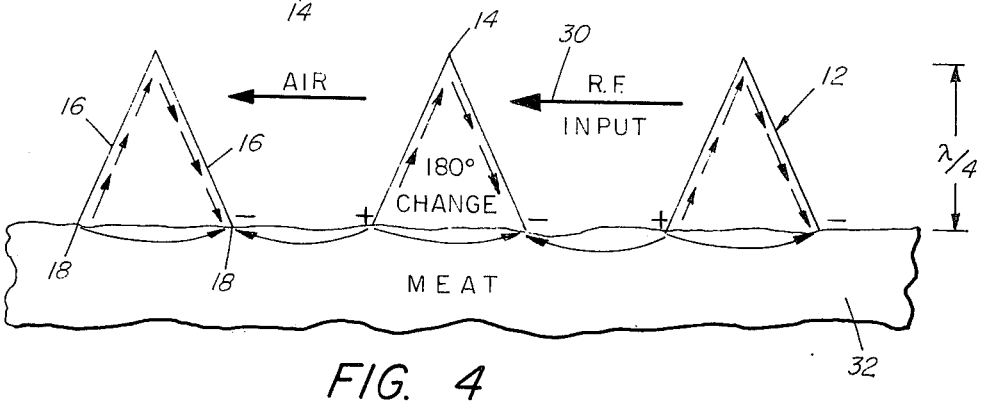
FIG. 4
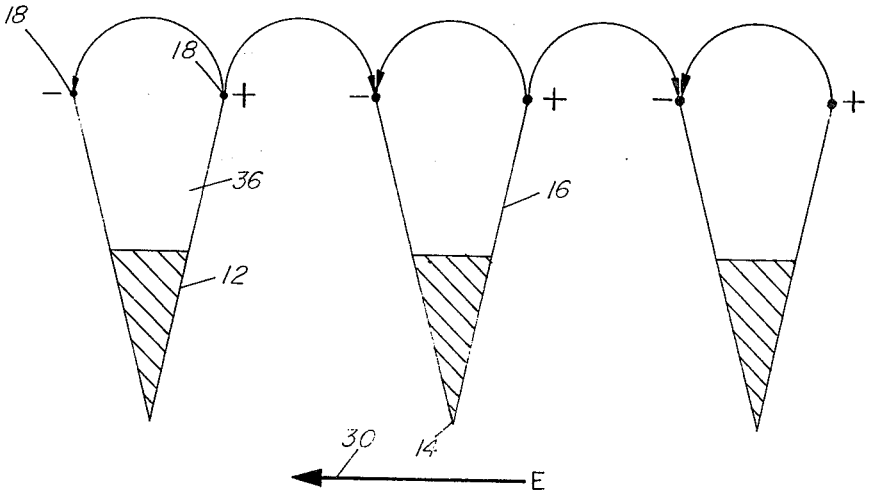
FIG. 5

MICROWAVE BROWNING UTENSIL

BACKGROUND OF THE INVENTION

1. Field of the Invention

The invention relates to microwave heating and means for producing a browned and seared surface.

2. Description of the Prior Art

Microwave heating has now become widely accepted for the preparation of industrial as well as domestic products. Electromagnetic waves at microwave frequencies are radiated within an enclosure from an energy source such as a magnetron. The microwaves are radiated and reflected within the enclosure in free space and are distributed by such means as mode stirrers and the like to uniformly surround and be absorbed by the load within the enclosure. The microwaves set up high frequency oscillatory movements of the molecules in the load to cause heating by molecular friction. The allocated frequencies for the microwave apparatus are assigned by federal regulatory agencies and are 915±13 MHz and 2450±50 MHz. The term microwaves is defined as electomagnetic energy radiation having wavelengths in the order of 1 meter to 1 millimeter and frequencies in excess of 300 MHz.

Materials exposed to microwave radiation have differing dielectric constant and loss tangent characteristics which results in heating in a varying pattern. As a result the varying absorption of the radiated energy causes the depth of penetration and surface coloration of the load to vary. Desirably a browned surface, similar to that produced by broiling, should be produced in loads radiated with microwave energy without requiring long exposure which results in overcooking of the interior regions. A browned and seared surface is difficult to attain without long exposure because the microwave oven enclosure is cooler during cooking compared to the electric and gas type prior art devices. Typically a surface temperature of approximately 350° to 400° F is required for a browned and seared surface. Prior art techniques for browning include the incorporation of electric or gas broiling elements in the microwave oven. Another method involves the coating of the outer surfaces with a food additive having a high energy absorbing characteristic which will lead to more rapid heating of the outer surfaces. Still another example of prior art teachings involves the use of lossy oven ware or utensils having selective heating capability by means of the use of conductive materials. Such conductive materials become heated from the absorbed energy and transfer this energy thermally to the supported load to function as a heat exchanger. Conductive materials have also been incorporated in a shelf of a dielectric material supporting a load within a microwave oven.

Still another example of a prior art teaching is the utensil described in U.S. Pat. No. 3,857,009 issued Dec. 24, 1974 to G. MacMaster et al and assigned to the assignee of the present invention. This structure incorporates a load supporting means for converting and transforming the free space energy waves into a fringing electric field pattern having a substantially 180° phase differential in close proximity to the exterior surfaces of the load. The means for converting and transforming the planar energy comprises alternating regions of high and low dielectric constant material. While the embodiments of this structure are efficient, easy to clean and relatively light weight, the cost of providing such high dielectric constant materials as those having a value of K38 or K50 tends to be costly. Further, in the patented structure the waves are directed through the dielectric material in varying degrees to evolve the 180° phase differential pattern. The 180° phase differential requires the use of plates having a predetermined height, typically, one-quarter of a wavelength and in certain dielectric materials this dimension can be higher than desired.

A continuing need is evidenced in the microwave heating field for new and improved means for providing the browned and seared surfaces particularly in such items as steaks, chops, fish fillets and the like.

SUMMARY OF THE INVENTION

In accordance with the teaching of the invention a utensil is provided having a plurality of conductive members with each being folded on itself to provide a continuous apex section and two substantially equidistant adjacent leg portions. A modified V-shaped member will provide an induced current along the leg portions to result in a 180° out-of-phase pattern at the free ends. The members have a height of one-quarter of a wavelength. The disclosed structure closely resembles a three port hybrid device used in microwaves with the input port being disposed at the apex or continuous portion of the folded member. The output port appears at the spaced free ends of the leg portions to define the induced fringing electric fields. The spacing between members referred to as pitch determines the depth of penetration of the energy. Closer spacings result in a field pattern for primarily browning and searing. Wider spacings provide for an increased depth of penetration of the fringing electric field for internal cooking along with the exterior surface cooking. The members are supported by end members and may be embedded in a dielectric material such as Silastic, a heat stable organo-silicon elastomer. The introduction of a dielectric material within the confines of the leg portions results in a lowering in the overall height of each of the conductive leg portions. In an exemplary embodiment the use of a material, such as Silastic, which provides for ease in cleaning of the utensil resulted in a reduction in the height of the individual V-shaped members from 1.3 inches to only 0.8 inches for the quarter wave dimension. The resultant utensil may be utilized for searing on one surface while a second similar member is disposed on the opposing surface of the load to provide for simultaneous searing on two sides.

The confines or interior surfaces of the V-shaped members will thereby provide for a third port which can be compared to a plunger arrangement since the variation of the dielectric materials disposed within the confines will determine the overall height of the utensil. The array of individual members may be provided in any desired length as well as width to accommodate the loads to be heated and space requirement for microwave oven enclosures.

BRIEF DESCRIPTION OF THE DRAWINGS

Details of the invention will be readily uderstood after consideration of the following description of an illustrative embodiment and reference to the accompanying drawings, wherein:

FIG. 1 is an isometric view of the illustrative embodiment of the invention;

FIG. 2 is a vertical cross-sectional view of a microwave heating apparatus;

FIG. 3 is a detailed cross-sectional view of a portion of the embodiment shown in FIG. 1 showing the reverse or cooking side of the utensil;

FIG. 4 is a diagrammatic representation for use in understanding the operation of the utensil; and FIG. 5 is a diagrammatic representation of an illustrative embodiment of the invention.

DESCRIPTION OF THE PREFERRED EMBODIMENT

Referring to FIG. 1 the browing and searing utensil 10 will provide an intense fringing electric field pattern in close proximity to the surfaces contacted of the load to be cooked. An array of conductive members 12 of a lightweight metal, such as aluminum is provided by folding over each of the members to have two adjacent leg portions 16 and a continuous apex portion 14 with the leg portions terminating in free ends 18. The article to be cooked is in contact with the ends 18. The leg portions 16 have a height dimension of substantially one-quarter of a free space wavelength of the microwave energy. The planar space waves distributed within the microwave oven induce currents in each of the leg portions 16 with the currents flowing 180° out-of-phase to provide a plus and minus operating mode at the free ends 18 in contact with the article being cooked. The currents then having a total excursion of approximately one-half of a wavelength. All of the conductive members 12 are provided with a space therebetween which may be filled with a dielectric material used in supporting the conductive members in the desired array. The embodiment of the invention provides for the transmission of the induced currents. There is no appreciable heating of the individual metallic members which may be present in the prior art devices which operate on the heat exchanger principle. The term "heat exchanger" denotes a device which requires heating of a component such as conductive rods or plate members and the transfer of the heat by conduction to a cold load surface.

The embodiment of the invention shown in FIGS. 1 and 3 comprises a plurality of the conductive members 12 which are supported at each end by members 20 and 22 which may be metal or dielectric. A material such as Silastic has been employed and this material may also be utilized in the spaces within the confines of the members 12 as well as the spaces between the respective members. The dielectric material 24 is between the conductive members 12 and 26 is within the confines defined by the leg portions of the conductive members 12.

The utensil may be utilized with the free ends 18 contacting the load which may either be superimposed on top of the utensil or the utensil may be positioned on top of the load. For rapid searing or browning two identical utensils may be employed one above and one below the load. The use of the Silastic material as well as any material having a dielectric constant higher than air will permit the shortening of the legs 16 to arrive at a thinner utensil for the quarter wavelength dimensional requirement.

Referring to FIGS. 4 and 5 the new heating concept will be described. Each V-shaped conductive member 12 provides a path for the induced electric currents from the waves impinging from free space radiated within an oven enclosure. The structure may be compared to a three port waveguide hybrid. The space between the conductive plate members is the input port for the free space waves designated by the arrow 30. In FIG. 4 the spacing between the conductive members 12 is designated as being air. The plane waves induce currents along the sides traveling therealong in a first direction and then in a reverse direction to provide substantially a 180° phase differential at the ends 18. The output section comprises the ends 18 disposed adjacent to the load 32 where the fringing electric field patterns are of sufficient intensity to result in browning and searing. The spacing between the conductive members 12 is determined by the desired depth of penetration of the microwave energy to result in internal cooking of the load in addition to the browning and searing.

The third port 36 comprises the interior spaces defined within the leg portions 16 and by control of the materials having the desired dielectric constant within this area a variable reactance is provided for tuning the overall induced currents in the utensil. Use of a dielectric material having a dielectric constant value of around 8 or 9 results in the overall height dimensions of the members 12 being substantially reduced. In an exemplary embodiment adapted for use in microwave ovens having a frequency of 2450 MHz the dimension of each leg 16 was reduced from 1.3 inches to 0.8 inches for the one-quarter wave height dimension. The spacing between the conductive members 12 in the exemplary embodiment was determined to be three-sixteenth of an inch which provided a satisfactory depth of penetration as well as the browned and seared surfaces. There is no restriction in the length of the members nor the width of the utensil which can be designed for the conventional oven enclosure dimension.

Referring to FIG. 2 an applicable microwave oven apparatus utilizing the embodiment of the invention is shown. The microwave oven apparatus 38 shown comprises parallel top and bottom conductive walls 40 together with side walls 42 to define the resonant oven enclosure 44. A door (not shown) is provided to enclose the access opening in one of the side walls. A case 46 is provided having a front panel 48 which supports the controls 50, 52 and 54 including push button controls and timers.

The magnetron energy generator 56 is of the well known type which is energized by rectified line voltages for DC operation and generates between 500 to 750 watts for conventional domestic types. The microwave energy is coupled to the enclosure by means of an antenna 58 and a launching rectangular waveguide 60. The planar waves 62 are launched through the open end 64 of the waveguide. The launched waves are efficiently distributed within the enclosure in a cyclical varying manner by such means as a mode stirrer 66 having a plurality of vanes 68 which are rotated by means of a motor 70. The launched planar waves bounce off the conductive walls at the top, side, rear and bottom of the oven enclosure.

The utensil 10 is supported on a dielectric plate member 72 which rests on shoulders 74 of a pan arrangement in bottom wall 40. In this embodiment the utensil is provided with the free ends 18 for supporting a load while the apex end 14 is disposed near the bottom wall of the oven. The utensil is very versatile and may be supported on top of a load to provide for the browning and searing. A shelf may also be provided incorporating the structure of the invention.

While the invention has been illustrated in connection with a plate-type utensil the invention may also be incorporated in conveyor belts or the utensil may be fixed and the material to be treated transported by a conveyor with a predetermined dwell time at each station to permit the browning and searing of the exterior surfaces. Such an arrangement is suited for large volume food processing such as hamburgers, french fries or chicken.

Numerous modifications will be evident to those skilled in the art. The foregoing description of the embodiment of the invention is, therefore, to be considered broadly and not in a limiting sense.

It is claimed that:

1. A utensil for use in cooking with microwave energy comprising:

a plurality of conductive members each having a configuration defining two substantially equidistant adjacent leg portions terminating in free ends and a continuous apex portion;

each conductive member leg portion having a height of substantially one-quarter of a wavelength of said energy; and means for supporting said members in an array whereby upon exposure to said energy induced currents flow which are substantially 180° out-of-phase between adjacent leg portions with a resultant fringing electric field adjacent to said free ends.

2. A utensil according to claim 1 wherein said conductive members are substantially V-shaped.

3. A utensil according to claim 1 wherein said support means comprise a dielectric material having a dielectric constant value exceeding the value of air and low energy losses disposed between said members.

4. A utensil according to claim 1 wherein a dielectric material having a dielectric constant value exceeding the value of air and low energy losses is disposed within the region defined between the leg portions of each member.

5. The combination comprising:

an enclosure;

means for radiating microwave electromagnetic energy within said enclosure; and means for receiving and converting said energy into a substantially fringing electric field pattern having a 180° phase differential adjacent to one surface;

said energy receiving and converting means comprising an array of a plurality of conductive members each having a configuration defining two substantially equidistant adjacent leg portions terminating in free ends and a continuous apex portion;

each conductive member having a height of substantially one-quarter of a wavelength of said energy; and means for supporting said conductive members in the desired array.

6. The combination according to claim 5 wherein said conductive members are substantially V-shaped.

* * * * *